US005205599A

United States Patent [19]

Wassmer et al.

[11] Patent Number: 5,205,599

[45] Date of Patent: Apr. 27, 1993

[54] AUXILIARY PROTECTIVE COIL LIFTER SADDLE

[75] Inventors: Peter J. Wassmer, Conneaut Lake; David G. Kiser, Franklin, both of Pa.

[73] Assignee: Drafto Corporation, Cochranton, Pa.

[21] Appl. No.: 928,989

[22] Filed: Aug. 12, 1992

[51] Int. Cl.[5] ..... B66C 1/62

[52] U.S. Cl. ..... 294/67.33; 294/103.2; 294/902

[58] Field of Search ..... 294/1.1, 16, 74, 82.1, 294/86.4, 67.2, 67.21, 67.22, 67.3, 67.33, 103.2, 902; 414/910, 911

[56] References Cited

U.S. PATENT DOCUMENTS

| | | | |
|---|---|---|---|
| 597,438 | 1/1898 | Schilling | 294/67.21 |
| 3,002,779 | 10/1961 | Frate et al. | 294/67 |
| 3,291,519 | 12/1966 | Burke | 294/67 |
| 3,450,428 | 6/1969 | Zimmerman | 294/82 |
| 3,655,232 | 4/1972 | Martelee | 294/67.33 |
| 3,771,666 | 11/1973 | Fournier | 212/21 |
| 4,245,861 | 1/1981 | Harry et al. | 294/67.2 X |
| 4,641,876 | 2/1987 | Kiser et al. | 294/86.4 |
| 4,709,953 | 12/1987 | Sirota | 294/106 |
| 4,717,188 | 1/1988 | Johnston | 294/67.2 |
| 4,784,419 | 11/1988 | Jensen et al. | 294/67.2 |
| 4,810,016 | 3/1989 | Greenhow | 294/67.21 |
| 4,919,465 | 4/1990 | Gembarosky et al. | 294/67.2 |

*Primary Examiner*—David M. Mitchell

*Assistant Examiner*—Dean J. Kramer

*Attorney, Agent, or Firm*—Webb, Burden, Ziesenheim & Webb

[57] ABSTRACT

An auxiliary protective coil lifter saddle adapted to be mounted on an arm of a coil lifter for transporting a coil of material having an inner surface defining a core, the arm having a lifting segment with a lifting surface and two side walls depending therefrom. The auxiliary protective coil lifter saddle includes a frame and a pad. The frame has a body with at least two opposite ends and a plurality of lugs, wherein at least one of the lugs attaches to a respective end of the body. The body and the lugs have upper surfaces and lower surfaces. The pad attaches to the upper surface of the body and is made of a soft resilient material such as polyurethane, whereby a bottom surface of the body can be placed on the lifting surface of the arm and the lugs deform so that the lugs depend from the body. The respective bottom surfaces of the lugs abut against the lifting segment. Accordingly, the inner surface of the coil rests on an upper surface of the pad. Also disclosed is a method of attaching the auxiliary saddle to a coil lifter, that includes placing the bottom surface of the body on the upper surface of the arms and subsequently deforming the lugs so that they depend from the body and the respective bottom surfaces of the lugs abut against the lifting segment. The saddle can be removed using a wedge.

20 Claims, 3 Drawing Sheets

AUXILIARY PROTECTIVE COIL LIFTER SADDLE

BACKGROUND OF THE INVENTION

1. Field of the Invention

This invention relates to coil lifters and handling devices used for transporting coils of material such as steel, aluminum or the like. More specifically, this invention relates to coil lifters which protect the coil of material.

2. Description of the Prior Art

Coil lifters and handling devices used by many industries generally employ one of two lifting approaches. The approaches vary by the way in which a coil of material is positioned. Certain coils of material do not possess sufficient strength, especially soon after formation or rolling, to be laid on their edges. These coils are positioned, at rest, with the core through the center of the coil running horizontally.

The coil lifters used in transporting coils positioned in this manner typically employ the following approach. The coil lifter is suspended over the coil to be transported. The lifter arms of said coil lifter are moved apart a distance in excess of the overall coil width. The lifter arms are lowered about the coil of material until lifting surfaces at a lower end of each lifter arm are positioned for entry into the circular coil core ends. The lifter arms are moved together to close about the coil of material. Specifically, the lifter arms are moved toward one another until the opposed front wall of each arm contacts with the edges of the coil therebetween. The lifter arms are then raised along the edges of the coil until the lifting surface of each arm contacts with the upper curvature of each coil core surface end. Thereupon, the coil lifter and coil of material can be raised and moved about for transportation of the coil. Exemplary of such coil lifters are U.S. Pat. Nos. 3,002,779; 3,771,666; 3,291,519; 4,641,876; 4,709,953; 4,717,188; 4,784,419 and 4,919,465.

For those coil lifters presently known in the art, there is normally no resultant damage caused by the initial contact of the front wall of each lifter arm with the edges of the coil. As shown in FIG. 1, early coil lifter designs damage the edges 1 of the coil 3 and the coil core surface 5 as the lifter arms raise therealong for the contacting of the lifting surfaces with the upper curvatures of each coil core end. Further, damage to the edges resulted when the coil was subsequently lowered after transportation. Most of the damage to the coil was to the edges as opposed to the coil core surface. Subsequent designs incorporated edge protectors and reduced coil edge damage. See, for example, U.S. Pat. No. 4,641,876. Presently, the coil lifters still damage the coil core and results in lost profit because the damaged portion must be removed from the coil.

Therefore, it is an object of my invention to provide a coil lifter that reduces or eliminates damage to the coil core surface during operation.

SUMMARY OF THE INVENTION

Accordingly, I have invented an auxiliary protective coil lifter saddle that can be mounted on an arm of a coil lifter for transporting a coiled material having an inner surface defining a core. The arm includes a lifting segment with a lifting surface and two side walls depending therefrom. The auxiliary protective coil lifter saddle includes a frame and a pad. The frame has a body with at least two opposite ends and a plurality of lugs, wherein at least one of the lugs attaches to a respective end of the body. The body and the lugs have upper surfaces and lower surfaces. The pad has an upper surface and a bottom surface. The pad attaches to the upper surface of the body and is made of soft resilient material, whereby a bottom surface of the body can be placed on the lifting surface of the arm, and the lugs deform so that the lugs depend from the body, and the respective bottom surfaces of the lugs abut against the lifting segments so that the inner surface of the coil rests upon an upper surface of the pad.

The frame can be made of a malleable metal such as 1020 steel, and the pad can be made of polyurethane. Further, the body can include a slot to receive a saddle trip plate. Preferably, the frame is sufficiently deformed during installation so that forces are exerted by the inner surfaces of each of the lugs against respective portions of the lifting segment. This results in frictional forces between the lugs and the lifting segment, which hold the auxiliary coil lifter saddle in place during operation of the coil lifter.

The body can include a third end positioned between the two opposite ends and having a third lug that is adapted to be received by a gap provided in the arm of the coil lifter. Furthermore, each of the two opposite ends can have at least two lugs, including a first lug that is longer than a second lug. The first lug can also have a fastener receiving hole for receiving a fastener to attach the frame to the arm. The body upper surface can be contained in a curved plane which is geometrically similar to a curved plane containing the lifting surface. Further, the body can include a chamfer that is formed on the lower surface of the body.

My invention is also a method for installing the coil lifter saddle on an arm of the coil lifter described hereinabove.

My invention also includes a combination of the above-described auxiliary protective coil lifter saddle and a wedge. The wedge includes a unitary tool having a tapered end and a striking head end, wherein to remove the auxiliary protective coil lifter saddle from a lifting segment, the wedge tapered end is forced between the body bottom surface and the lifting surface and thereby separating the body from the lifting surface.

DESCRIPTION OF THE PREFERRED EMBODIMENTS

Figure 1:
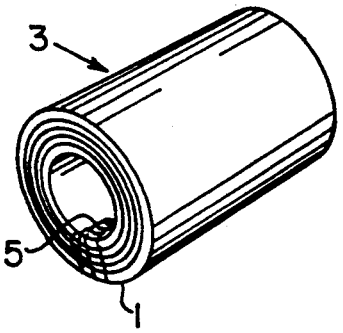
FIG. 1 is a perspective view of a coil of material having a damaged end portion.
Figure 2:
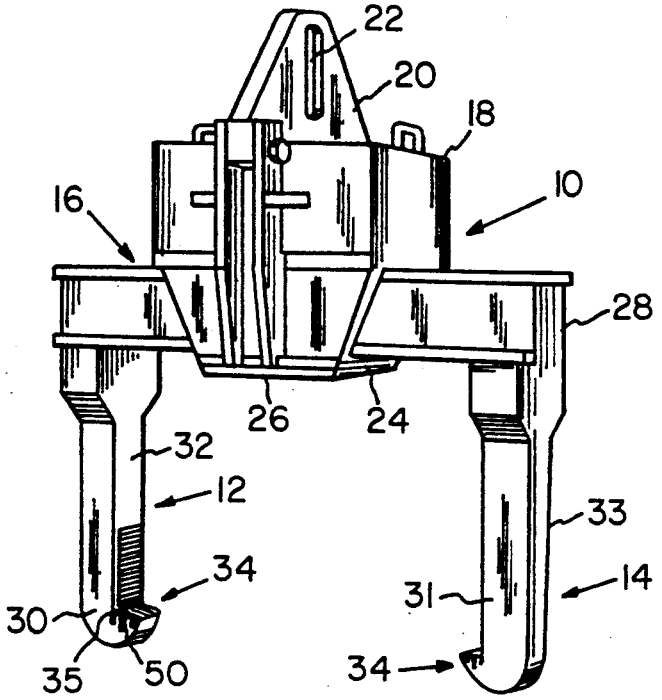
FIG. 2 is a perspective view of a coil lifter made in accordance with the present invention.

A coil lifter 10 incorporating the core protection of my invention is shown in FIG. 2. The coil lifter 10 is similar to that described in U.S. Pat. No. 4,641,876, which is incorporated herein by reference. The coil lifter 10 includes a first lifter arm 12, a second lifter arm 14 and an upper housing 16, from which lifter arms 12 and 14 are connected and downwardly suspended. The housing 16 includes a suspension portion 18 and an upward extension 20. The upward extension 20 has an eyelet 22 through which a chain (not shown) or the like can be threaded for suspending the coil lifter 10 over a coil of material. Preferably, a lower pedestal 24 of the suspension portion 18 is covered with a soft, yielding or resilient material 26 for cushioning the side of a coil in contact therewith.

A lifter arm channel 28 extends horizontally through and outwardly beyond the lower half of the suspension portion 18 of the coil lifter 10. Lifter arms 12 and 14 connect to and extend downwardly from channel 28. Both lifter arms 12 and 14 are slidably mounted to move within the housing 16. Together, the lifter arms 12 and 14 and channel 28 form a fabricated unit.

The lifter arms 12 and 14 attach to corresponding racks, not shown, within the lifter arm channel 28. These racks are joined together by a commonly known pinion gear, also not shown, so that the turning of the pinion gear determines the mutual movement of the racks and lifter arms 12 and 14 toward and away from one another. By the rotation of this pinion gear, the lifter arms can be made to open and close about a coil of material.

Figure 3:
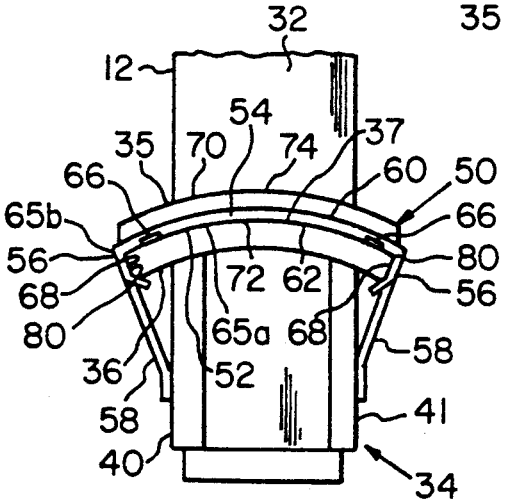
FIG. 3 is a front view of a portion of the coil lifter saddle and an auxiliary protective coil lifter saddle made in accordance with the present invention.
Figure 4:
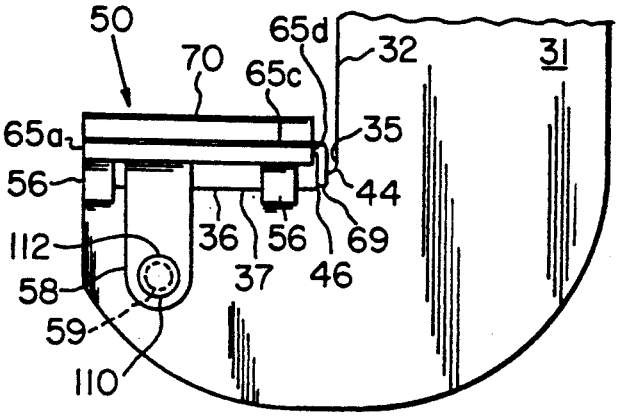
FIG. 4 is a side view of the portion of the coil lifter and the auxiliary coil lifter saddle shown in FIG. 3.
Figure 5:
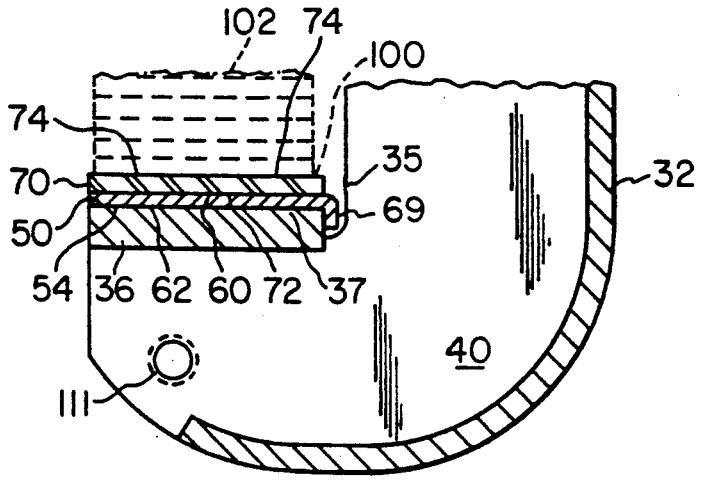
FIG. 5 is a partial section of the portion of the coil lifter and the auxiliary protective coil lifter saddle shown in FIGS. 3 and 4, with a coil of material in phantom.

Each lifter arm 12 and 14 includes a pair of side walls 30 and 31, respectively, a front wall 32 and a rear wall 33 opposite the front wall. The walls 30, 31, 32 and 33 are joined together along adjacent edges to form an elongated, rectangular structure. Lifting segments 34 protrude inwardly from a lower end 35 of the front wall 32 of each lifter arm 12 and 14. These lifting segments 34 enter the coil core ends for eventual raising of the coil of material. As shown in FIGS. 3–5, each lifting segment 34 includes a saddle 36 having a convex curvature shaped lifting surface 37. The saddle 36 extends perpendicularly beyond the front wall 32.

The curvature of the lifting surface 37 corresponds to the inner curvature at each circular coil core surface end. Each lifting segment 34 also includes a pair of spaced apart segment walls 40, 41 that attach to and depend from the saddle 36. Segment walls 40 and 41 are attached to walls 30 and 31, respectively. Preferably, segment walls 40 and 41 are integral with walls 30 and 31. A gap 44 is defined between wall 32 and a rearward end 46 of the saddle 36.

An auxiliary protective coil lifter saddle 50 attaches to the saddle 36. The auxiliary protective coil lifter saddle 50 includes an integral frame 52 having a body 54 and a plurality of lugs 56 and 58 and a pad 70. Preferably, the frame 52 is made of a malleable metal such as 1020 steel. Lugs 58 are longer than lugs 56, and lugs 58 include a hole 59. The body 54 includes a convex shaped upper surface 60 and a concave shaped lower surface 62 and includes four sides or ends **65*a*, 65*b*, 65*c* and 65*d*. Side 65*a* of the body has two chamfers 66 positioned at opposite ends that extend from the lower surface 62 of the body. Each side 65*b* and 65*c* has two lugs 56 and one lug 58 depending therefrom, with lug 58 positioned between lugs 56 so that respective bottom surface 68 of the lug 58 abuts against respective segment walls 40 and 41 and bottom surfaces 68 of lugs 56 abut against saddle 36. Two rear lugs 69, integrally attached to the body 54, depend from side 65*d* and is received within gap 44**.

The pad 70, made of a soft resilient material, such as plastic, rubber or polyurethane, attaches to the body 54. The pad 70 includes a bottom surface 72 and an upper surface 74. The bottom surface 72 of the pad 70 attaches to the body upper surface 60 through an adhesive or through molding the polyurethane directly onto the metal of the body 54 or in any other known method of attaching the polyurethane member to the body 54. These modes of attaching are well-known in the art. In this manner, the inner surface 100 of a coil 102 rests on the upper surface 74 of the pad 70 when the coil 102 is positioned on or carried by the coil lifter 10.

Preferably, the lugs 56 and 58 are bent in such a manner that they abut against lifting segments 34. Specifically, lugs 56 are bent so that they abut against saddle 36 where a portion of the lugs 56 contacts a lower surface of the saddle 36, whereby a recess 80 is formed by the lugs 56 and the body 54 which receives and sandwiches said portions of the saddle 36. This restrains upward movement of the auxiliary saddle 50 with respect to the saddle 36. Lugs 58 abut against walls 40 and 41, exert a force against the walls 40 and 41 and/or the saddle 36 and, thereby, restrain upward movement of the auxiliary saddle 50 with respect to the saddle 36 by the frictional forces between the bottom surface 68 of the lugs 58 and walls 40 and 41. Further, rear lugs 69 also assist in preventing the auxiliary protective coil lifter saddle 50 from being pulled off the lifting segments 34 in a forward direction.

Optionally, the auxiliary protective coil lifter saddle 50 can be mechanically attached to the lifting segment 34 by a fastener 110, such as a screw. Specifically, threaded holes 111 are provided in walls 40 and 41 that align with holes 59 of lugs 56 when the auxiliary protective coil lifter saddle 50 is set in place. Screws 110 pass through the respective holes 59 and those of walls 40 and 41 so that the head 112 of the screw hold the auxiliary saddle 50 in place.

Figure 6:
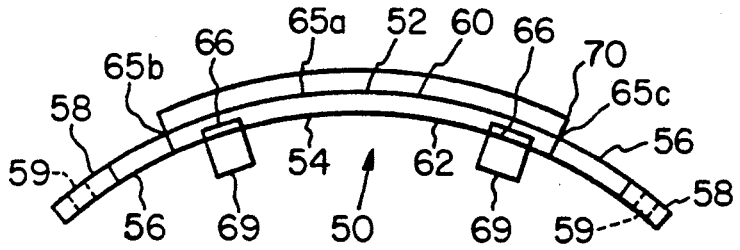
FIG. 6 is a side view of an undeformed auxiliary protective coil lifter saddle.
Figure 7:
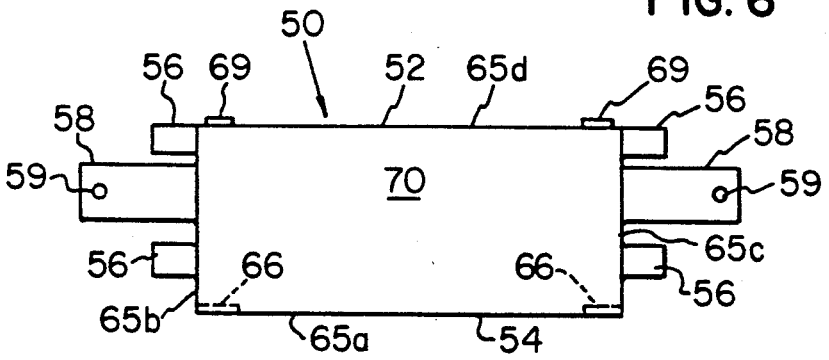
FIG. 7 is a top view of the auxiliary protective coil lifter saddle shown in FIG. 6.
Figure 8:
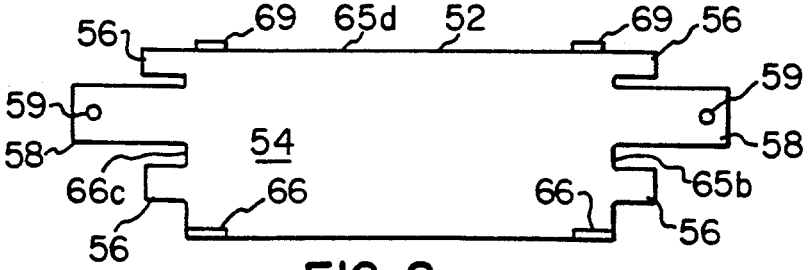
FIG. 8 is a bottom view of the auxiliary protective coil lifter saddle shown in FIG. 6.

Installation of the auxiliary saddle 50 is as follows. Prior to installation, the auxiliary protective coil lifter saddle 50, as shown in FIGS. 6–8, includes the frame 52 having a curved body 54. The upper surface 60 and lower surface 62 are curved to conform with the convex shape of the lifting saddle 36, which are contained in geometrically similar curved panes. The lugs 56 and 58 are in an undeformed state and extend from the respective sides **65*b* and 65*c* of the body 54. The rear lugs 69 depend from the rear side 65*d* of the body 54 and the chamfers 66 are formed at side 65*a* in the lower surface 62 of the body 54**.

First, the lower surface 62 of the body 54 is placed upon the lifting surface 37 of the coil lifting segment 34.

The rear lugs 69 are positioned in the gap 44. The chamfers 66 are positioned between the body upper surface 60 and the lifting surface 37. Lugs 56 and 58 are then deformed by hammering so that they depend from the body 54. Respective bottom surfaces 68 of lugs 56 abut against the saddle 36 so that a portion of the lugs contacts a lower surface of the saddle 36, thereby forming recess 80 and sandwiching a portion of the saddle 36 between the lugs 56 and the frame 52. Respective bottom surfaces 68 of the lugs 56 abut against respective side surfaces 40 and 41 and holes 59 align with the respective holes 111 in walls 40 and 41. Screws 110 are then passed through holes 59 of lugs 58 and then threaded into the respective holes 111 of walls 40 and 41 until the head 112 of the screws 110 abut against upper surfaces of the lugs 58. Thus, the auxiliary protective coil lifter saddle 50 can be held in place during operation of the coil lifter.

Figure 9:
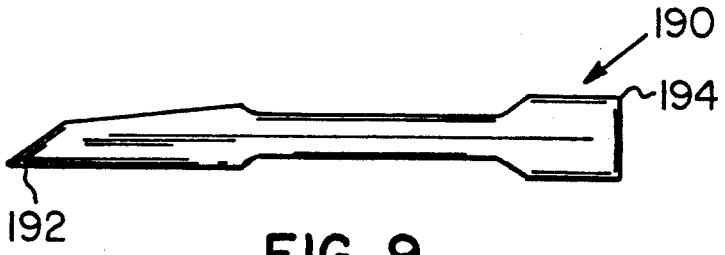
FIG. 9 is a side view of a wedge made in accordance with the present invention.
Figure 10:
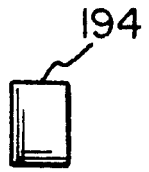
FIG. 10 is an end view of the wedge shown in FIG. 9.
Figure 11:
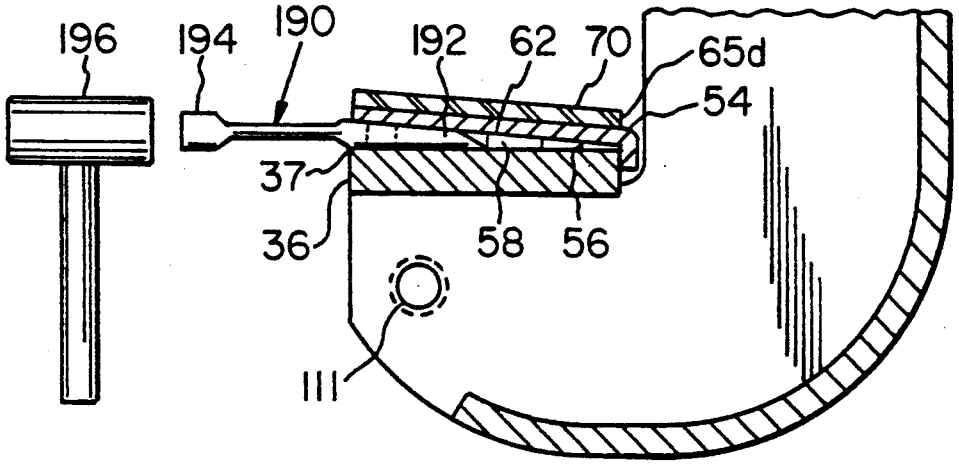
FIG. 11 is a side view, partially in section, showing the wedge positioned between the auxiliary protective coil lifter saddle and a saddle of a coil lifter.

The auxiliary protective coil lifter saddle 50 can be easily removed from the arms 12 and 14 by using a wedge 190, shown in FIGS. 9–11. The wedge 190 includes a unitary tool having a double tapered end 192 and a striking head end 194. When screws or fasteners 110 have been used, they are initially removed. Then, the double tapered end 192 of the wedge 190 is positioned against one of the chamfers 66. Next, a hammer or mallet 196 is used to hit the striking head end 194 of the wedge 190, thereby, forcing the double tapered end 192 toward body end **65*d* and between the lifting surface 37 and the body lower surface 62. This causes the body 54 to be separated from the lifting surface 37 and redeforming the lugs 56 and 58, so that the auxiliary saddle 50 can be pulled away from the saddle 36 and removed. The above-described installation procedure then can be implemented to attach a replacement auxiliary protective coil lifter saddle 50 onto the saddle 36 of the coil lifter 10**. This process takes only a couple of minutes and is inexpensive to implement.

Figure 12:
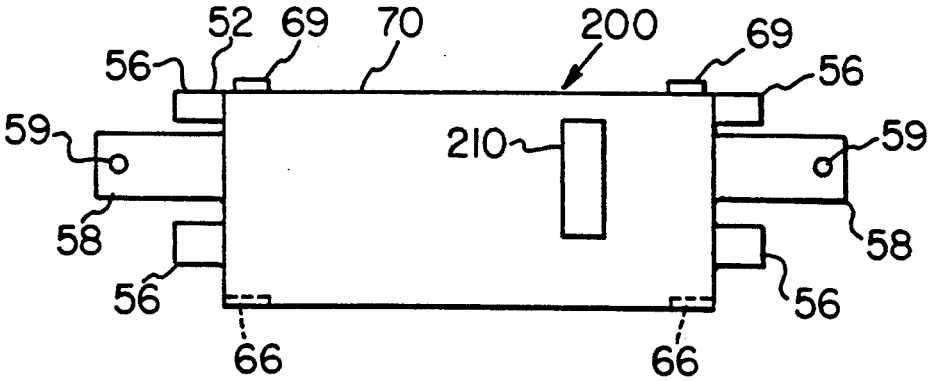
FIG. 12 is a top view of an undeformed auxiliary coil lifter saddle with a saddle trip plate receiving slot made in accordance with the present invention.

Some coil lifters 10 have depressible trip plates provided in their lifting segments 34 that extend above the saddle 36. These mechanisms are activated when a coil is placed on the saddle 36 and depresses the plate, thereby activating known safety features of the coil lifter 10. FIG. 12 shows a modified auxiliary protective coil lifter saddle 200 that includes a hole 210 through both the pad and body to permit a trip plate to pass therethrough. Auxiliary saddle 50 and auxiliary saddle 200 are identical with the exception of the hole 210 for a trip plate.

The auxiliary protective coil lifter saddle 50 can be used on many different designs of coil lifters. For example, if the coil lifting surface were a flat lifting surface, then the respective surfaces 60 and 62 of the body 54 would be flat; or if no gap 44 were provided on the lifter arms 12 and 14, then the rear lugs 69 would be eliminated.

Having presently described the preferred embodiments of my invention, it is to be understood that it may be otherwise embodied within the scope of the appended claims.

I claim:

1. An auxiliary protective coil lifter saddle adapted to be mounted on an arm of a coil lifter for transporting a coil of material having an inner surface defining a core, the arm having a lifting segment with a lifting surface and two side walls depending therefrom, said auxiliary protective coil lifter saddle comprising:

a frame having a body with at least two opposite ends and a plurality of lugs, wherein at least one of said lugs attaches to a respective end of said body, and with said body and said lugs having upper surfaces and lower surfaces; and a pad having an upper surface and a bottom surface, said pad attached to said upper surface of said body and made of a soft resilient material, whereby a bottom surface of said body can be placed on the lifting surface of the arm and said lugs deformed so that said lugs depend from the body, and said respective bottom surfaces of said lugs abut against the lifting segment so that the inner surface of the coil rests on an upper surface of said pad.

2. The auxiliary protective coil lifter saddle of claim 1 wherein said frame is made of malleable metal.

3. The auxiliary protective coil lifter saddle of claim 2 wherein said frame is made of 1020 steel.

4. The auxiliary protective coil lifter saddle of claim 1 wherein said pad is made of polyurethane.

5. The auxiliary protective coil lifter saddle of claim 1 wherein said frame is sufficiently deformed during installation so that a force is exerted by the inner surfaces of each of said lugs against respective portions of the lifting segment resulting in frictional forces between said lugs and the lifting segment that holds said auxiliary coil lifter saddle in place during operation of the coil lifter.

6. The auxiliary protective coil lifter saddle of claim 1 wherein said body includes a slot to receive a saddle trip plate.

7. The auxiliary protective coil lifter saddle of claim 1 wherein said body includes a third end positioned between said two opposite ends, said third end having a third lug adapted to be received by a gap provided in the arm of the coil lifter.

8. The auxiliary protective coil lifter saddle of claim 1 wherein each of said two opposite ends each have at least two lugs, including a first lug that is longer than a second lug.

9. The auxiliary protective coil lifter saddle of claim 8 wherein each of said first lugs includes a fastener receiving hole for receiving a fastener to attach said frame to the arm.

10. The auxiliary protective coil lifter saddle of claim 1 wherein said body upper surface is contained in a curved plane and the lifting surface is contained in a geometrically similar curved plane.

11. The auxiliary protective coil lifter saddle of claim 1 wherein said body includes a chamfer.

12. The auxiliary protective coil lifter saddle of claim 11 wherein said chamfer is formed on said lower surface of said body.

13. A method of installing an auxiliary protective coil lifter saddle adapted to be mounted on an arm of a coil lifter for transporting a coil of material having an inner surface defining a core, the arm having a lifting segment with at least a lifting surface and two side walls depending therefrom, said auxiliary protective coil lifter saddle including a frame having a body with at least two opposite ends and a plurality of lugs, wherein at least one of said lugs attaches to a respective end of said body, said body and said lugs having an upper surface and a lower surface, and a pad having an upper surface and a bottom surface, said pad attached to said upper surface of said body and made of a soft resilient material, said method comprising the steps of:

placing the bottom surface of the body on the lifting surface of the arm; and subsequently deforming said lugs so that they depend from the body and said respective bottom surfaces of said lugs abut against said lifting segment.

14. The method of claim 13 wherein said deformed lugs frictionally hold said auxiliary saddle in place.

15. The method of claim 13 further comprising the step of:

mechanically attaching said lugs to said arms.

16. The method of claim 15 wherein screws mechanically attach said lugs to said arms.

17. The method of claim 13 further comprising:

redeforming said deformed lugs; and removing said body from said arm.

18. The method of claim 13 further comprising:

forcing a wedge between said body bottom surface and said lifting surface, and thereby separating said body from said lifting surface.

19. A coil lifter adapted to lift a coil having a coil core, said coil lifter comprising:

an upper housing adapted to be suspended over a coil of material;

a pair of spaced lifter arms connected to and extending downwardly from said housing, each of said lifter arms having a front wall opposed to each other and a lifting surface at a lower end of each arm adapted to fit within a coil core, each of said arms having a lifting segment with a lifting surface;

means for effecting movement of said arms relative to each other to open and close said arms about a coil; and a removable auxiliary protective coil lifter saddle mounted on said arm, said saddle comprising:

a frame having a body with at least two opposite ends and a plurality of lugs, wherein at least one of said lugs attaches to a respective end of said body, said body and said lugs having upper surfaces and lower surfaces; and a pad having an upper surface and a bottom surface, said pad attached to said upper surface of said body and made of a soft resilient material, whereby a bottom surface of said body can be placed on the lifting surface of the arm and said lugs deformed so that said lugs depend from the body, and said respective bottom surfaces of said lugs abut against said lifting segment so that the inner surface of the coil rests on an upper surface of said pad.

20. In combination, an auxiliary protective coil lifter saddle adapted to be mounted on an arm of a coil lifter for transporting a coil of material having an inner surface defining a core, the arm having a lifting segment with a lifting surface and two side walls depending therefrom, and a wedge, said auxiliary protective coil lifter saddle comprising:

a frame having a body with at least two opposite ends and a plurality of lugs, wherein at least one of said lugs attaches to a respective end of said body, said body and said lugs having upper surfaces and lower surfaces;

a pad having an upper surface and a bottom surface, said pad attached to said upper surface of said body and made of a soft resilient material, whereby a bottom surface of said body can be placed on the lifting surface of the arm and said lugs deformed so that said lugs depend from the body, and said respective bottom surfaces of said lugs abut against the lifting segment so that the inner surface of the coil rests on an upper surface of said pad; and said wedge comprising a unitary tool having a tapered end and a striking head end, wherein to remove said auxiliary protective coil lifter saddle body from said lifting segment, said wedge tapered end is forced between said body bottom surface and said lifting surface and thereby separates said body from said lifting surface.

* * * * *